US009437939B2

(12) United States Patent
Saje et al.

(10) Patent No.: US 9,437,939 B2
(45) Date of Patent: Sep. 6, 2016

(54) FLOW DRILL SCREW ATTACHED GROUNDING BLOCK

(71) Applicant: GM GLOBAL TECHNOLOGY OPERATIONS LLC, Detroit, MI (US)

(72) Inventors: Robert N. Saje, Shelby Township, MI (US); Charles E. Jensen, Macomb, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 14/036,593

(22) Filed: Sep. 25, 2013

(65) Prior Publication Data

US 2015/0087168 A1 Mar. 26, 2015

(51) Int. Cl.

| | |
|---|---|
| ***H01R 4/64*** | (2006.01) |
| ***H01R 4/66*** | (2006.01) |
| ***H01R 13/648*** | (2006.01) |

(52) U.S. Cl.

CPC *H01R 4/64* (2013.01); *H01R 4/66* (2013.01); *H01R 13/648* (2013.01)

(58) Field of Classification Search

CPC ... B60R 16/02; B60R 16/0238; B60R 16/06; H01R 13/648; H01R 13/6485; H01R 13/652; H01R 13/655; H05F 3/02

See application file for complete search history.

(56) References Cited

U.S. PATENT DOCUMENTS

| | | | | |
|---|---|---|---|---|
| 3,029,405 | A * | 4/1962 | Buchanan | 439/95 |
| 3,169,353 | A * | 2/1965 | Krulwich | 451/375 |
| 3,363,715 | A * | 1/1968 | Langdon | 180/170 |
| 4,201,433 | A * | 5/1980 | Caldwell | 439/98 |
| 5,941,716 | A * | 8/1999 | Yoshigi | 439/95 |
| 6,031,185 | A * | 2/2000 | Bouveret et al. | 174/84 R |
| 6,241,200 | B1 * | 6/2001 | Camporeale et al. | 248/68.1 |
| 6,976,884 | B1 * | 12/2005 | Lee | 439/638 |
| 7,241,151 | B1 * | 7/2007 | Bradshaw | 439/95 |
| 7,492,996 | B2 * | 2/2009 | Kowalczyk et al. | 385/100 |
| 7,537,467 | B1 * | 5/2009 | Gretz | 439/108 |
| 7,621,787 | B2 * | 11/2009 | Lu | 439/811 |
| 7,805,064 | B2 * | 9/2010 | Ragay et al. | 392/416 |
| 7,867,044 | B2 * | 1/2011 | Lee | 439/883 |
| 7,993,155 | B2 * | 8/2011 | Heichal et al. | 439/374 |
| 8,480,414 | B2 * | 7/2013 | Carnevale et al. | 439/97 |
| 2001/0029120 | A1 * | 10/2001 | Miyazaki et al. | 439/98 |

(Continued)

FOREIGN PATENT DOCUMENTS

| | | | |
|---|---|---|---|
| CN | 102082332 | A | 6/2011 |
| JP | 2009283375 | A | 12/2009 |
| JP | 2013073738 | A | 4/2013 |

OTHER PUBLICATIONS

Chinese Patent and Trademark Office, Office Action for China Patent Application No. 201410502340.4 mailed Feb. 1, 2016.

*Primary Examiner* — Barry Gooden, Jr.

(74) *Attorney, Agent, or Firm* — Lorenz & Kopf, LLP

(57) ABSTRACT

A grounding block is provided. The grounding block includes a means for fastening and a formed metallic block. The formed metallic block further comprises two or more flanges, where each flange is configured to accept the means for fastening. The formed metal block further comprises a uniform clearance formed into the underside of the grounding block between the flanges and a hole formed through the grounding block configured to accept a bolt. Various embodiments include angled surfaces to optimize assembly ergonomics and variable depth to optimize the mass of the blocks.

12 Claims, 6 Drawing Sheets

(56) References Cited

U.S. PATENT DOCUMENTS

2004/0203269 A1* 10/2004 Kameyama et al. ..... 439/108
2006/0022522 A1* 2/2006 Plummer ..... 307/9.1
2008/0210725 A1* 9/2008 Birtwisle et al. ..... 224/309
2008/0266198 A1* 10/2008 Walker et al. ..... 343/846
2009/0156065 A1* 6/2009 Lee ..... H01R 4/305
439/781
2011/0299246 A1* 12/2011 Van Giesen et al. ..... 361/692
2012/0206852 A1* 8/2012 Fitz ..... 361/216
2012/0264327 A1* 10/2012 Carnevale et al. ..... 439/449
2014/0069227 A1* 3/2014 Kawaguchi ..... 74/560
2014/0148026 A1* 5/2014 Nomura et al. ..... 439/188

* cited by examiner

FLOW DRILL SCREW ATTACHED GROUNDING BLOCK

TECHNICAL FIELD

The technical field generally relates to the electrical grounding blocks. Specifically, an improved, ergonomic, grounding block is provided. Embodiments herein are particularly suited for dry environments but are not so limited herein.

BACKGROUND

Electrical systems of all types are usually connected to a ground for safety and for operational considerations. This ground is ultimately connected to the earth in stationary circumstances such as with systems installed in buildings. In vehicles, a physical connection to ground is usually not feasible. As such electrical systems in a vehicle are connected to the vehicle's structural chassis/body, which is often used as a common ground. The vehicle chassis/body is often referred to as being in a wet environment because it is not unusual for it to be exposed to water, dirt, grease, oil and other foreign matter, which may or may not aggravate corrosion or other electrical problems.

To minimize corrosion of chassis/body components in wet environments and to ensure a solid electrical connection, components requiring electrical attachment to the chassis/body are typically welded to the chassis/body such that the water tight integrity of the chassis/body is not broken and a secure connection is maintained. However, welding is in fact a permanent attachment such that the replacement of a welded part (i.e., a grounding block) requires considerable effort to grind through the weld, which may in and of itself cause unavoidable damage to the chassis/body.

Grounding blocks are usually a minor component in manufacturing a vehicle. FIG. 1 is a rendition of a conventional grounding block 10, which is secured to the chassis/body 2 by a weld 3. The typical grounding block has some type of attachment point 1. Grounding blocks are relatively cheap, relatively heavy, designed for single use, and simply connect wires to the chassis/body. Thus, less time is applied to designing grounding blocks to facilitate connection or disconnection by assembly crews and repair technicians. Material weight reductions may also be realized. Thus, it is desirable to address these issues and produce an improved vehicle thereby.

Further, other desirable features and characteristics of the present invention will become apparent from the subsequent detailed description and the appended claims, taken in conjunction with the accompanying drawings and the foregoing technical field and background.

SUMMARY

A grounding block is provided. The grounding block comprises a means for fastening and a formed metallic block. The formed metallic block comprises two or more flanges, where each flange is configured to accept the means for fastening. The formed metal block further comprises a uniform clearance formed into the underside of the grounding block between the flanges and a hole formed through the grounding block configured to accept a bolt.

DESCRIPTION OF THE DRAWINGS

The exemplary embodiments will hereinafter be described in conjunction with the following drawing figures, wherein like numerals denote like elements, and wherein.

DETAILED DESCRIPTION

The various illustrative components described in connection with the embodiments disclosed herein are merely exemplary and which may be modified with a multitude of adjustments to the various components disclosed herein without departing from the scope of this disclosure. The word "exemplary" is used exclusively herein to mean "serving as an example, instance, or illustration." Any embodiment described herein as "exemplary" is not necessarily to be construed as preferred or advantageous over other embodiments.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. Any process steps may be interchanged in any order without departing from the scope of the invention as long as such an interchange does not contradict the claim language and is not logically nonsensical.

Further, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

Figure 1:
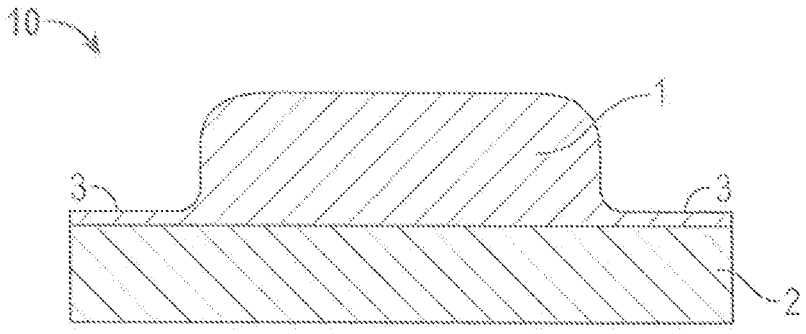
FIG. 1 (Prior Art)
FIG. 1 is a rendition of a conventional grounding block.
Figure 2:
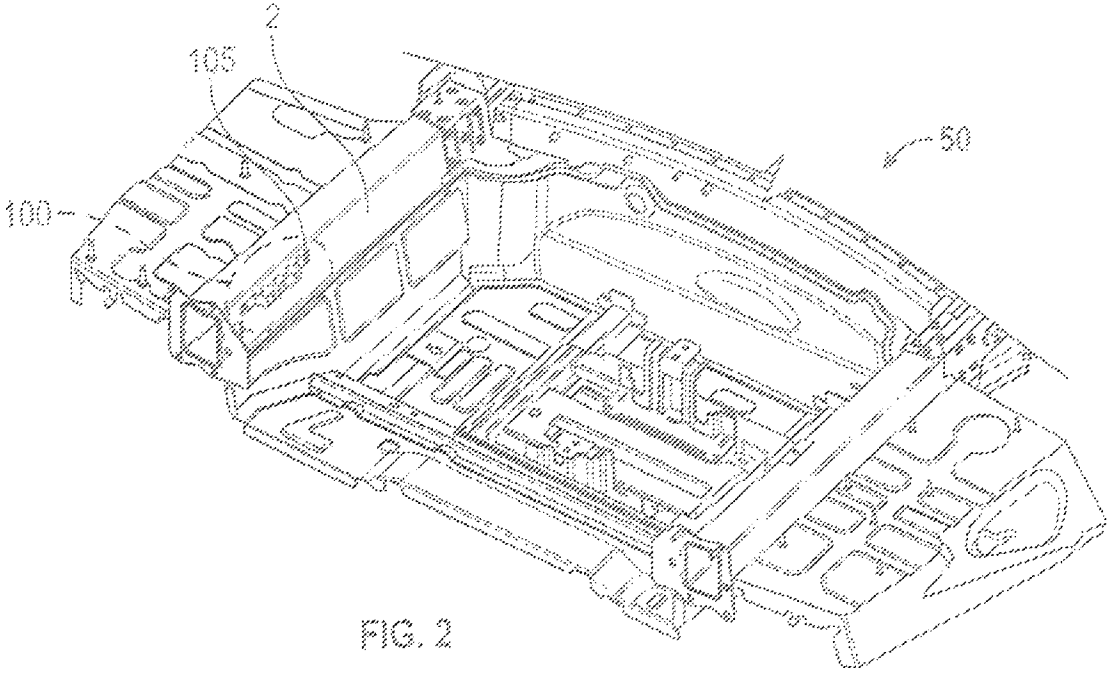
FIG. 2 is a large scale view of an exemplary vehicle body portion with a grounding block installed according to embodiments.

FIG. 2 is a large scale view of an exemplary vehicle body portion 50 that includes an exemplary conductive metallic grounding block 100 secured to a chassis/body 2 (e.g., a crush can) according to embodiments. The grounding block 100 is attached to the chassis/body 2 by fastening means 103. Exemplary fastening means 103 may be any type of suitable reversible securing device known in the art such as a screw, bolt or nut of any description. In some preferred embodiments, the reversible securing device may be flow drill screws that have the advantage of reinstating the water tight integrity of the chassis/body once the ground block is installed and which may be removed more easily than a weld is case repair or replacement is necessary. Flow drilling is well known in the art and will not be discussed herein further in the interest of brevity and clarity. In alternative embodiments the grounding block 100 may be permanently welded or riveted (i.e. permanent fastening means) to the chassis/ body 2 if so desired. The grounding block in some embodiments is comprised of aluminum but is operable when constructed of any other conductive material.

Figure 3B:
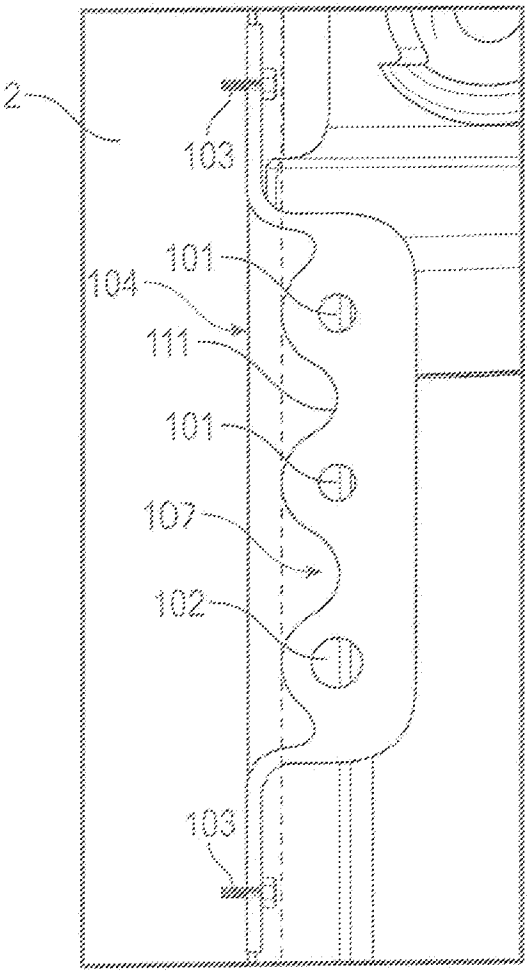
FIGS. 3A and 3B illustrate an exemplary embodiment of a grounding bock installed on a chassis/body/body according to embodiments.
Figure 3A:
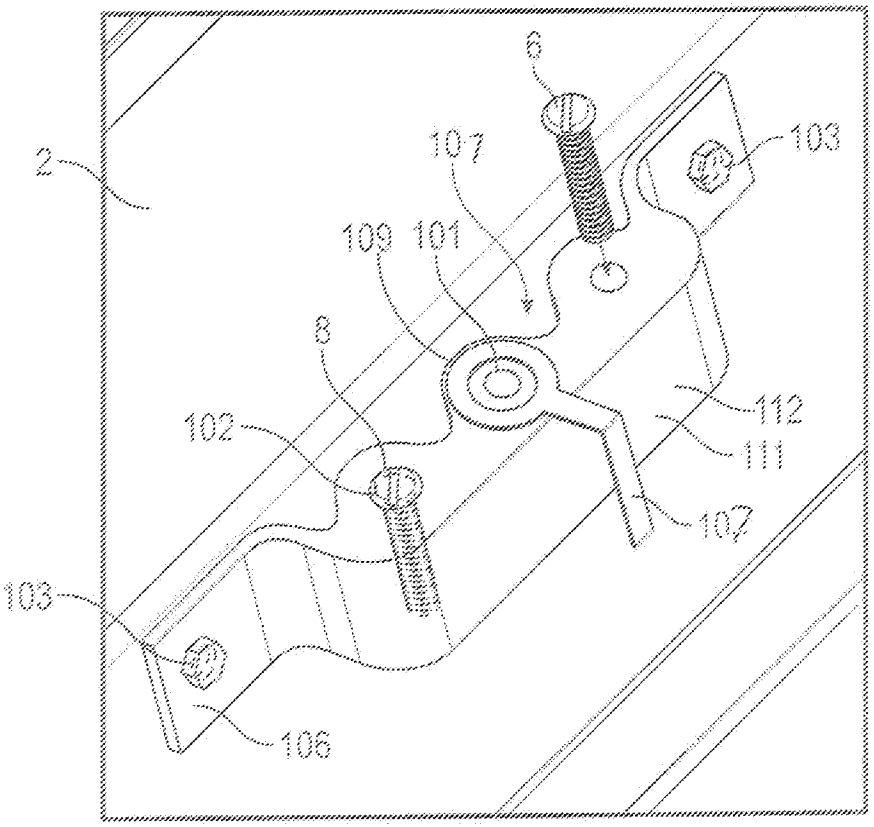

FIG. 3A is an oblique view of an exemplary embodiment of the grounding block 111 attached to a chassis/body 2 while FIG. 3B is a side view of the same embodiment. The grounding block 111 has two flanges 106 that serve as attachment points to the chassis/body 2. The flanges 106 may be welded, riveted, bolted, screwed or otherwise electrically and physically fastened to the chassis/body. Holes 108 in the flanges 106 are provided for fastening means 103.

The grounding block 111 is depicted as essentially a rectangular solid with a top surface 112 but may be extruded or otherwise manufactured with other shapes as may prove to be advantageous such as a cylinder, multi-faceted cylinder, a triangular solid, a pyramid, a truncated pyramid, etc. In this exemplary embodiment the upper corners of the grounding block 111 are rounded off to reduce weight. Similarly, underside cut outs 107 are also formed or cut into the grounding block 111 to reduce weight.

Further, additional material is removed on the underside of the grounding block 111 to ensure that there is sufficient clearance 104 between the chassis/body 2 and the underside of the grounding block 111 such that flexation or vibration of the grounding block 111 and/or chassis/body 2 does not cause the block to impact the chassis/body 2 thereby causing a rattle. The clearance 104 may be approximately 2-3 mm from a bottom surface of the grounding block after the weight reducing cutouts 107 are factored in. In other embodiments the clearance my range from 1-6 mm depending on the severity of vibration and the length of the grounding block. Such anti-rattle clearances apply to this embodiment and the following embodiments.

The grounding block 111 includes one or more transverse (i.e. side-to-side) bolt holes (101,102) completely through the grounding block 111 to accommodate terminal bolts (6, 8). The diameter of the transverse bolt holes may differ to accommodate different size bolts such as a 6 mm ("M6") and/or 8 mm ("M8") bolts. The bolts (6, 8) secure an electrical wire 105 to the grounding block 111. The electrical wire 105 comprises an attachment eye with a tab 109 that engages a surface of the grounding block 111 that is prepared to engage the tab 109.

Figure 4B:
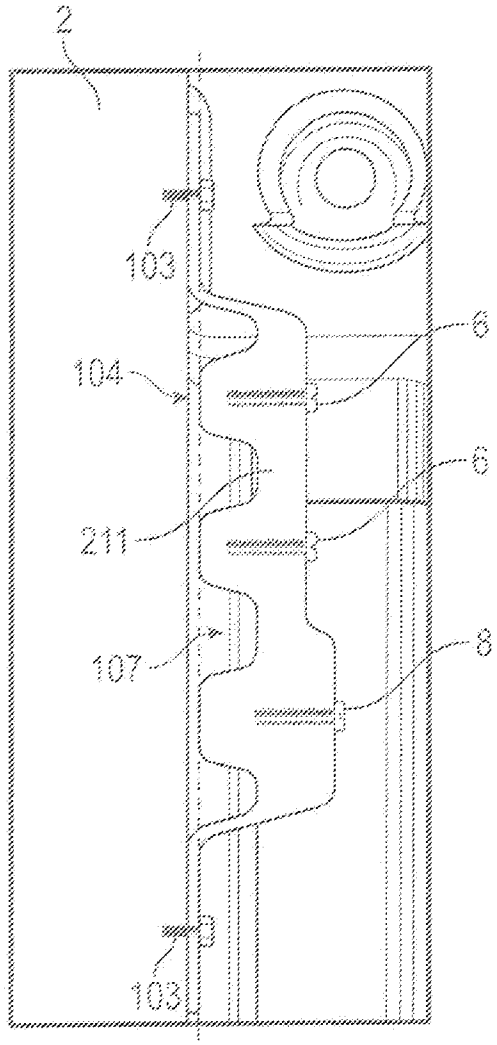
FIGS. 4A and 4B illustrate another exemplary embodiment of the grounding bock installed on a chassis/body according to embodiments.
Figure 4A:
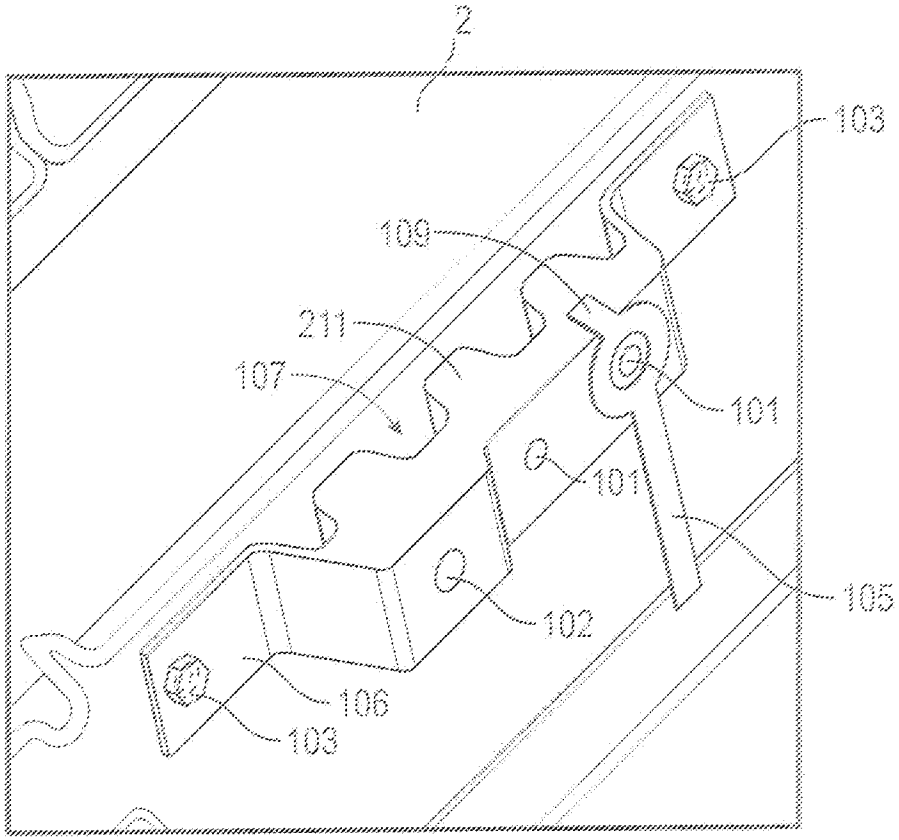

FIG. 4A is an oblique view of another exemplary embodiment of the grounding block 211 attached to a chassis/body 2 while FIG. 4B is a side view of the same embodiment. The grounding block 211 has two flanges 106 that server as attachment points to the chassis/body 2. The flanges may be welded, riveted, screwed bolted or otherwise electrically and physically fastened to the chassis/body. Holes 108 are provided for screw, bolt or rivet attachment.

The grounding block 211 is depicted as essentially a rectangular solid with a top surface 212 but may be extruded or otherwise manufactured with other shapes as may prove to be advantageous such as a cylinder, multi-faceted cylinder, a triangular solid, a pyramid, a truncated pyramid, etc. Similarly, underside cut outs 107 are also formed into the block to reduce weight.

Further, additional material is removed on the underside of the grounding block 211 to ensure that there is sufficient clearance 104 between the chassis/body 2 and the underside of the grounding block 211 such that flexation or vibration of the block and or chassis/body does not cause the block to impact the chassis/body 2, thereby causing a rattle.

The grounding block 211 includes one or more bolt holes (101,102) completely through the grounding block 211 via the upper surface to accommodate terminal bolts (6, 8). The diameter of the bolt holes may differ to accommodate different size bolts such as a 6 mm ("M6") and/or 8 mm ("M8") bolts. The bolts (6, 8) secure an electrical wire 105 to the grounding block 211. The electrical wire 105 comprises an attachment eye with a tab 109 that engages a surface if he grounding block 211 that is prepared to engage the tab 109.

Further, the height (H) of the grounding block 211 may be increased or decreased to accommodate the length of a standard bolt of a specific size, such that the upper surface comprises two or more parallel planes (A, B). For example the standard M8 bolt 8 is longer than the standard M6 bolt so that the height of the block at plane B is increased to provide sufficient clearance for the bolt to avoid contacting the chassis/body 2 when properly and fully inserted.

Figure 5B:
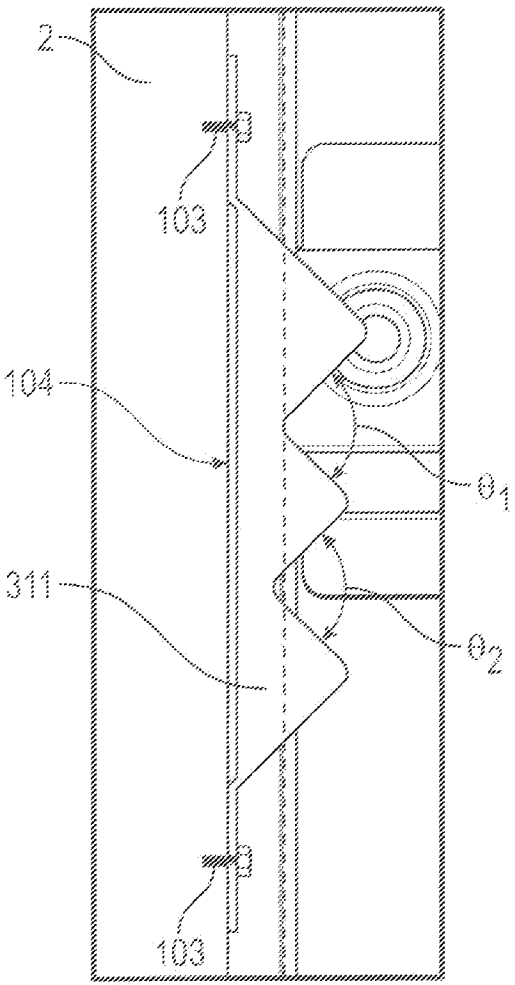
FIGS. 5A and 5B illustrate another exemplary embodiment of a grounding bock installed on a chassis/body according to embodiments.
Figure 5A:
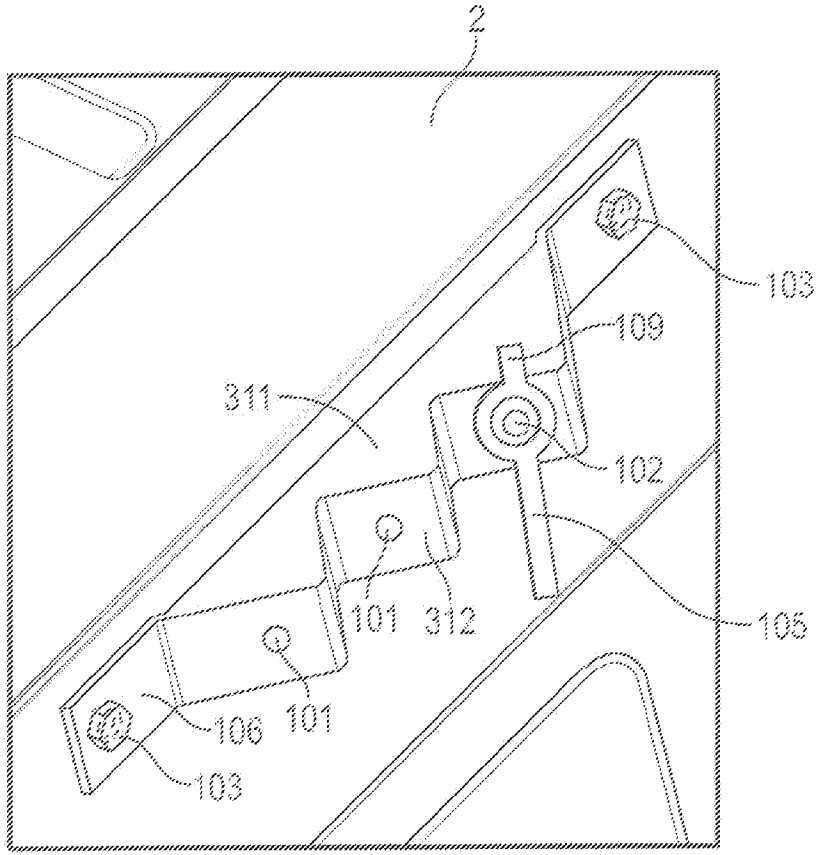

FIG. 5A is an oblique view of an exemplary embodiment of the grounding block 311 attached to a chassis/body 2 while FIG. 5B is a side view of the same embodiment. The grounding block 311 has two flanges 106 that serve as attachment points to the chassis/body 2. The flanges 106 may be welded, riveted, bolted, screwed or otherwise electrically and physically fastened to the chassis/body. Holes 108 are provided for screw or rivet attachment.

The grounding block 311 is depicted as essentially a rectangular solid, the top surface 312 of which is configured into a triangular or sawtooth shape. Material is removed on the underside of the grounding block 311 to ensure that there is sufficient clearance 104 between the chassis/body 2 and the underside of the grounding block 311 such that flexation or vibration of the grounding block 311 or the chassis/body 2 does not cause the block to impact the chassis/body 2 thereby causing a rattle.

The grounding block 311 includes one of more triangular structures with a face that is formed at an angle of $\theta_n$ relative to a plane parallel to a plane formed between the flanges 106. Angel $\theta_n$ may be any angle that may be necessary or desirable to facilitate the ergonomic attachment of an electric cable 105 into the grounding block 311.

One or more bolt holes (101,102) are formed completely through the top surface 312 of the grounding block 311 normal to one or both upper faces (C, D) of the triangular structure to accommodate the insertion of terminal bolts (6, 8). The diameter of the bolt holes (101, 102) may differ to accommodate different size bolts such as a 6 mm ("M6") and/or 8 mm ("M8") bolts. The bolts (6, 8) attach the electrical wire 105 to the grounding block 311. The electrical wire 105 comprises an attachment eye with a tab 109 that engages a surface of the grounding block 311 that is prepared to engage eh tab 109.

Figure 6:
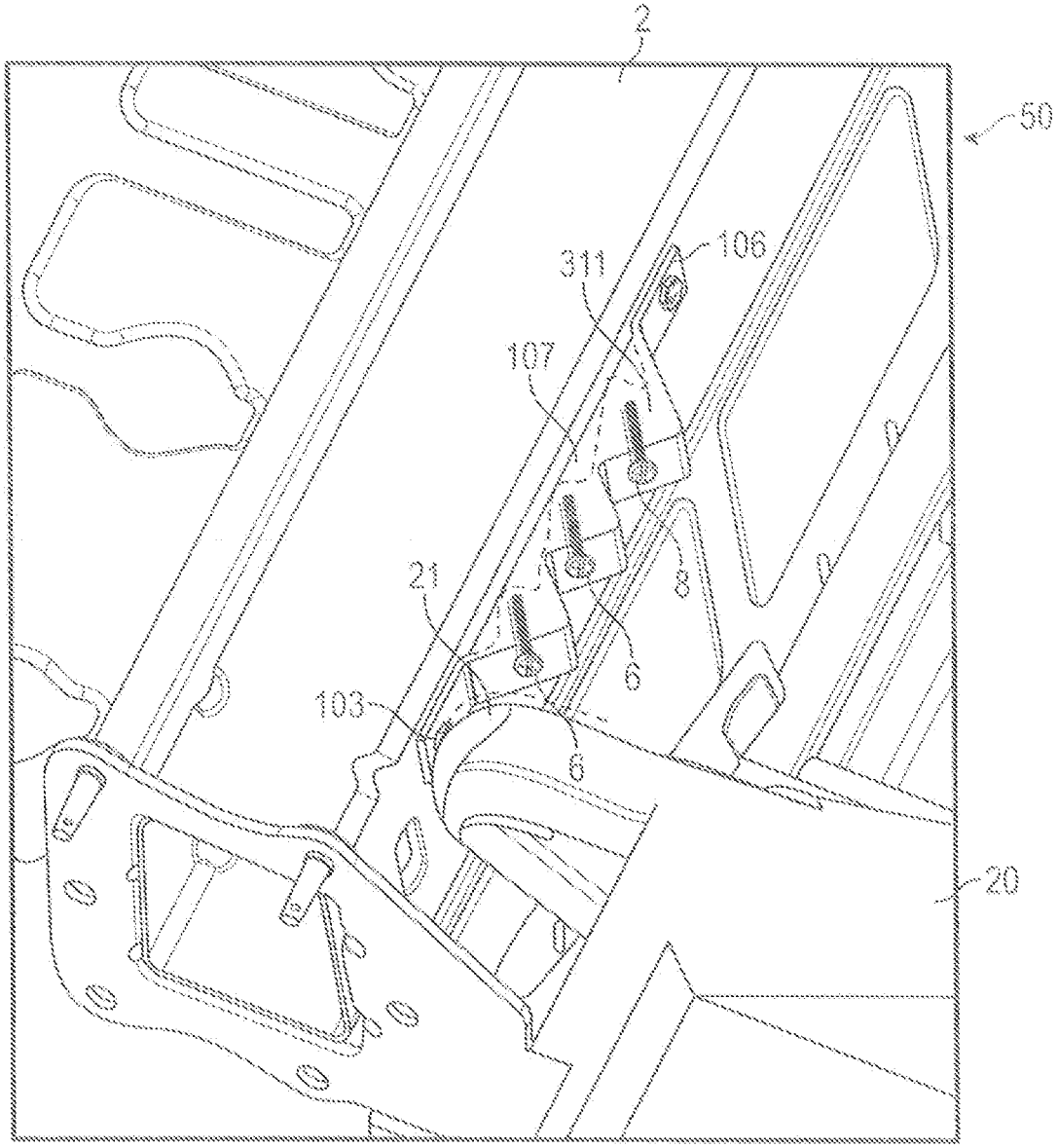
FIG. 6 illustrates a grounding block being attached by a power screwdriver.

FIG. 6 illustrates the embodiment of FIGS. 5A and 5B being attached by a screwdriver 20. The screwdriver 20 may be any manual or power screwdriver know in the art. As a non-limiting example, the screwdriver may be a flow drill screwdriver Thus, the flange 106 is large enough to accommodate access by the tip 21 of the screwdriver 20. In this particular depiction, weight cutouts 107 (see, dotted line) may be removed to reduce the weight of the grounding block.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claim and the legal equivalents thereof.

What is claimed is:

1. A grounding block with a top surface and underside comprising:

a means for fastening; and a contiguous formed metallic block, wherein the formed metallic block further comprises:

two or more flanges;

a first hole through each of the two or more flanges configured to accept the means for fastening;

a uniform clearance formed into the underside of the grounding block between the flanges; and a second hole formed through the grounding block configured to accept one of a bolt or a screw, wherein:

the grounding block varies in a thickness between the underside of the grounding block and the top surface of the grounding block along a length thereof;

the grounding block is attached to a surface by a flow screw; and the top surface is triangular.

2. The grounding block of claim 1, wherein the top surface is planar.

3. The grounding block of claim 1, wherein a surface of the triangular top surface comprises a hole normal to the top surface that is configured to receive one of a bolt or a screw.

4. The grounding block of claim 1, wherein the formed metallic block is comprised of aluminum.

5. The grounding block of claim 1, wherein:

the grounding block has a body having a body top surface and a body underside;

the two or more flanges extend from the body, specifically from the body top surface and the body underside; and each of the two or more flanges has a respective flange top surface and a flange bottom surface, the flange top surface extending from and aligned with the body top surface, and the flange underside extending from and aligned with the body underside.

6. The grounding block of claim 1, wherein the top surface of the grounding block comprises at least two different, parallel, flat surfaces.

7. The grounding block of claim 6, wherein the at least two different, parallel, flat surfaces each comprise a hole normal to each of the at least two surfaces that is configured to receive one of a bolt and a screw, wherein the surface with a larger height accommodates a larger bolt or screw.

8. The grounding block of claim 7, wherein one bolt is insertable from each of the at least two different, parallel, flat surfaces.

9. A vehicle body portion comprising:

a chassis/body; and a grounding block with a top surface and underside, the grounding block further comprising:

a means for fastening, and a contiguous formed metallic block, wherein the formed metallic block further comprises:

two or more flanges, a first hole through each of the two or more flanges configured to accept the means for fastening, a uniform clearance formed into the underside of the grounding block between the two or more flanges, and a second hole formed through the grounding block configured to accept a bolt, wherein:

the grounding block varies in a thickness between an underside of the grounding block and the top surface of the grounding block along a length thereof;

the grounding block is attached to a surface by a flow screw; and the top surface is triangular.

10. The vehicle body portion if claim 9, wherein the top surface is planar.

11. The vehicle body portion of claim 9, wherein a surface of the triangular top surface comprises a hole normal to the top surface that is configured to receive a bolt.

12. A grounding block comprising:

a triangular top surface; and an underside comprising:

a means for fastening; and a formed metallic block, wherein the formed metallic block further comprises:

two or more flanges;

a first hole through each of the two or more flanges configured to accept the means for fastening;

a uniform clearance formed into the underside of the grounding block between the flanges; and a second hole formed through the grounding block configured to accept one of a bolt or a screw.

* * * * *